US007637694B1

(12) United States Patent
Musser

(10) Patent No.: US 7,637,694 B1
(45) Date of Patent: Dec. 29, 2009

(54) ADJUSTABLE DRAIN FOR STONE DECKING

(76) Inventor: Darell W. Musser, 1001 W. Harris Rd., Arlington, TX (US) 76001

( * ) Notice: Subject to any disclaimer, the term of this patent is extended or adjusted under 35 U.S.C. 154(b) by 0 days.

(21) Appl. No.: 11/823,963

(22) Filed: Jun. 29, 2007

(51) Int. Cl.
*E02B 5/00* (2006.01)

(52) U.S. Cl. ..... 405/118; 405/36; 405/119; 404/2; 404/4

(58) Field of Classification Search ..... 405/36, 405/43, 48, 118, 119; 404/2, 3, 4, 5, 26; 52/19, 20; 210/163, 164
See application file for complete search history.

(56) References Cited

U.S. PATENT DOCUMENTS 4,815,888 A 3/1989 Stegmeier
5,211,461 A * 5/1993 Teufel et al. ..... 312/334.4
5,380,121 A * 1/1995 Schluter ..... 404/14
5,454,663 A 10/1995 Stegmeier
5,784,838 A * 7/1998 Phillips ..... 52/169.5
D466,596 S * 12/2002 Stegmeier et al. ..... D23/267

* cited by examiner

*Primary Examiner*—David J Bagnell
*Assistant Examiner*—Benjamin Fiorello

(57) ABSTRACT

An adjustable drain has an elongate base element and an elongate drain element. The elongate base element has upwardly extending walls extending upwardly from the elongate base element. The elongate drain element has a top surface supported by downwardly extending walls, and the top surface has a plurality of apertures enabling water to drain through the top surface. First interlocking elements are vertically spaced from each other on the upwardly extending walls, and second interlocking elements are spaced apart from each other on the downwardly extending walls, enabling the elongate drain element to engage the elongate base element in either a first position or a second position, adapting to either smaller or larger pavers.

11 Claims, 3 Drawing Sheets

ADJUSTABLE DRAIN FOR STONE DECKING

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to drains adapted for installation with stone decking, and more particularly to a drain that is adjustable in height so that the drain may be used with stone decking of differing thicknesses.

2. Description of Related Art

Drains used to facilitate drainage from decking are known in the art. For example, Stegmeier, U.S. Pat. No. 4,815,888, teaches a drain used to facilitate drainage from swimming pool decking. The drain includes a polymer plastic drain apparatus for use in aggregate decking areas of a swimming pool. The drain is comprised of an elongated trough adapted for burial in the aggregate and is formed of a bottom wall and parallel spaced apart upright sidewalls terminating at their upper distal ends in a bifurcated formation defining an intervening space of selected cross-section. Adapted to overlie the trough in a removable mounting relation thereto is an apertured grating having elongated skirts downwardly depending from the longitudinal edges thereof. The skirts are insertable within the intervening spacing of the bifurcated trough formation in a springlike interfit enabling the grating to be removed and replaced as appropriate.

Stegmeier, U.S. Pat. No. 5,454,663, teaches a replacement re-cover drain top for a deteriorated top of an existing drain situated in swimming pool decking. The re-cover top is of a channel-like section and is adapted when installed to overlie an existing drain from which its previous top has been at least partially removed. Drain apertures in the top communicate with the drain on which it is installed from below the upper surface of the top to a depth corresponding at least to the flush level of the adjacent decking. The above-described references are hereby incorporated by reference in full.

The prior art teaches drains for decking. However, the prior art does not teach a drain that is adjustable in height so that the drain may be used with stone decking of differing heights.

The present invention fulfills these needs and provides further related advantages as described in the following summary.

SUMMARY OF THE INVENTION

The present invention teaches certain benefits in construction and use which give rise to the objectives described below.

The present invention provides an adjustable drain that includes an elongate base element and an elongate drain element. The elongate base element has upwardly extending walls extending upwardly from the elongate base element. The elongate drain element has a top surface supported by downwardly extending walls, and the top surface has a plurality of apertures enabling water to drain through the top surface. First interlocking elements are vertically spaced from each other on the upwardly extending walls, and second interlocking elements are spaced apart from each other on the downwardly extending walls, enabling the elongate drain element to engage the elongate base element in either a first position or a second position.

A primary objective of the present invention is to provide an adjustable drain having advantages not taught by the prior art.

Another objective is to provide an adjustable drain that is adjustable in height so that the drain may be used with decking of differing heights A further objective is to provide an adjustable drain that can be extruded at a low cost.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 3:
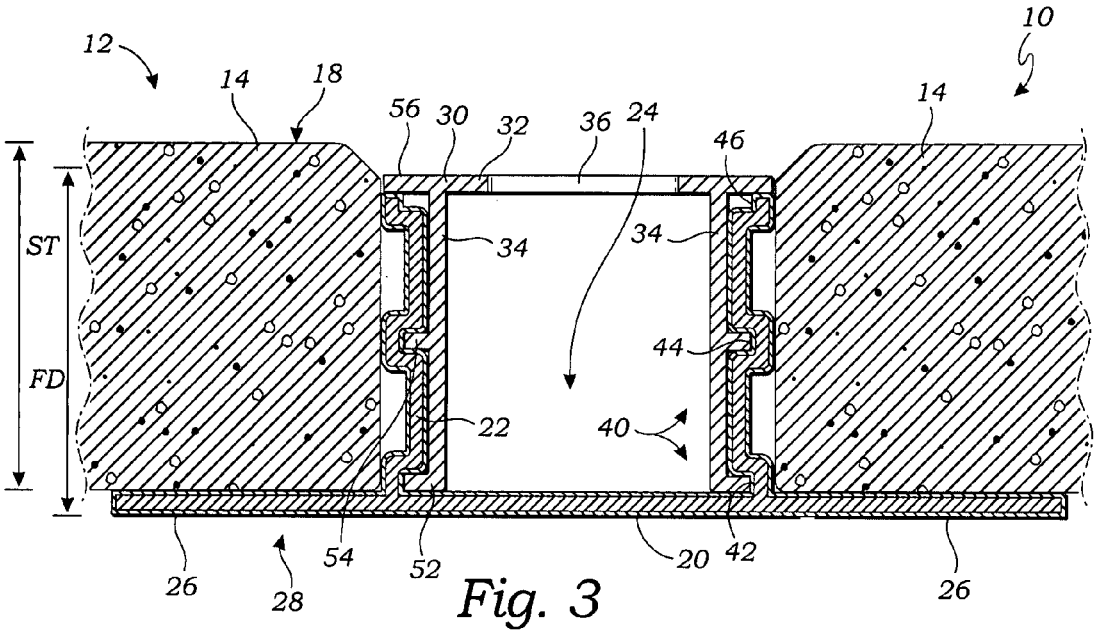
FIG. 3 is a sectional view thereof taken along line 3-3 in FIG. 2, further illustrating how outwardly extending base flanges of the elongate base element fit beneath smaller pavers of a stone decking.
Figure 6:
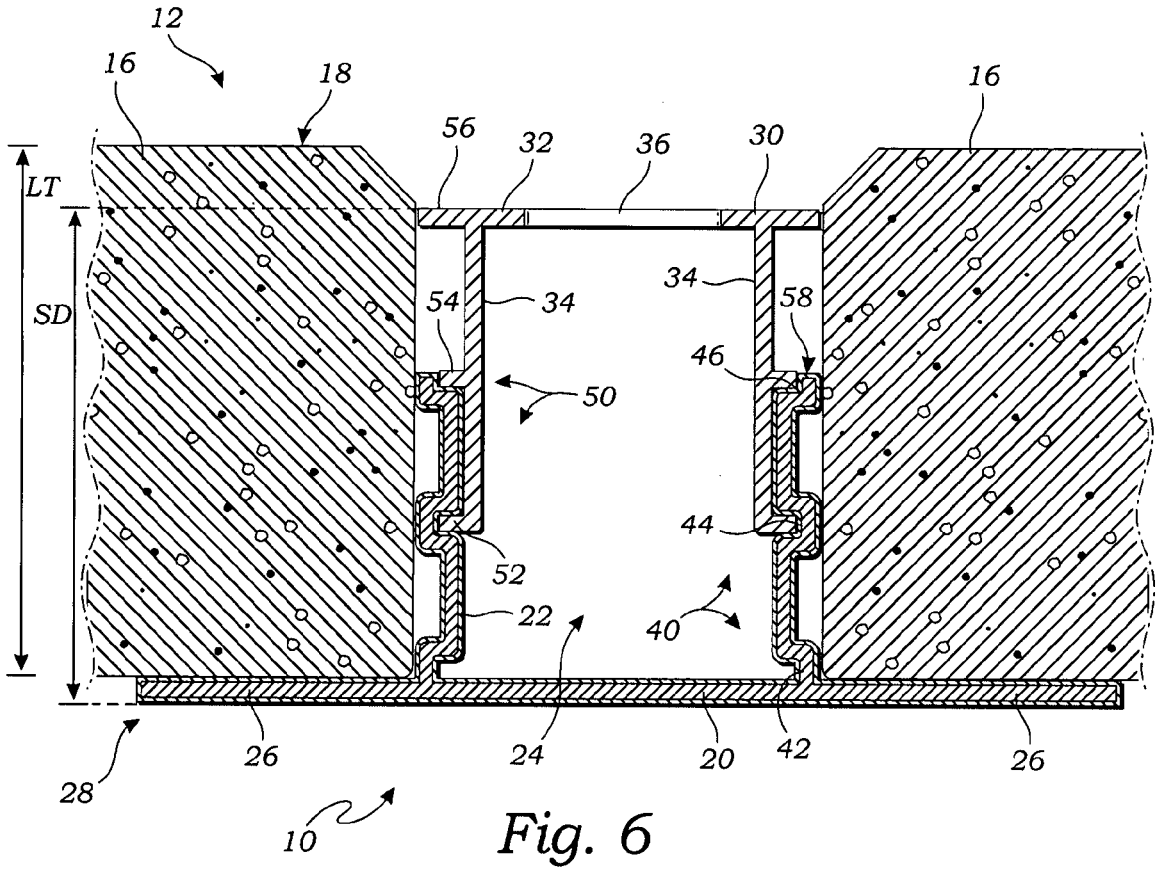
FIG. 6 is a sectional view thereof taken along line 6-6 in FIG. 5, illustrating how the outwardly extending base flanges of the elongate base element fit beneath larger pavers of a stone decking.

The above-described drawing figures illustrate the invention, an adjustable drain 10 that is adapted to be adjusted for use with multiple sizes of pavers in the construction of stone decking 12 (shown in FIGS. 3 and 6). In the embodiment illustrated herein, the adjustable drain 10 is adapted for stone decking 12 that includes either smaller pavers 14 (shown in FIG. 3) having a smaller thickness ST, or larger pavers 16 (shown in FIG. 6) having a larger thickness LT. The height of the adjustable drain 10 may be adjusted to fit either the larger pavers 16 or the smaller pavers 14.

Figure 1:
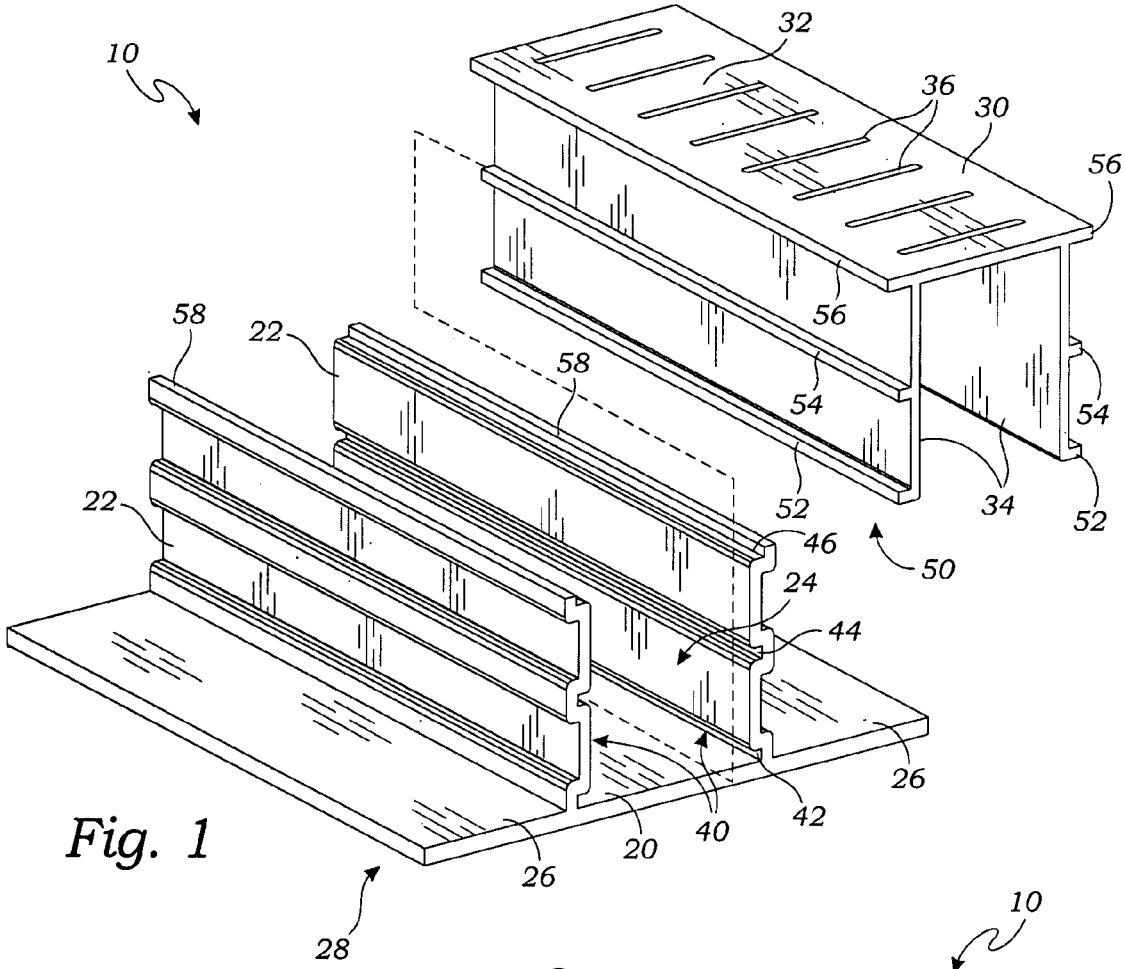
FIG. 1 is an exploded perspective view of an adjustable drain according to a preferred embodiment of the present invention.

FIG. 1 is an exploded perspective view of the adjustable drain 10 according to a preferred embodiment of the present invention. As shown in FIG. 1, the adjustable drain 10 includes an elongate base element 20 and an elongate drain element 30 that engage each other in either a first position (when used with the smaller pavers 14 of FIG. 3) or a second position (when used with the larger pavers 16 of FIG. 6).

As shown in FIG. 1, the elongate base element 20 includes upwardly extending walls 22 extending upwardly from the elongate base element 20. The upwardly extending walls 22 are preferably parallel and laterally spaced from one another, although those skilled in the art may devise alternative embodiments that are not so structured. The elongate base element 20 and the upwardly extending walls 22, together, define a water drainage channel 24.

In the preferred embodiment, the elongate base element 20 further includes outwardly extending base flanges 26 extending from the elongate base element 20. The base flanges 26 form a generally planar anchoring structure 28 adapted to fit under the stone decking 12 adjacent the adjustable drain 10, as illustrated in FIGS. 3 and 6.

As illustrated in FIG. 1, the elongate drain element 30 has a top surface 32 supported by downwardly extending walls 34. The top surface 32 includes a plurality of apertures 36 enabling water to drain through the top surface 32 and into the water drainage channel 24. The downwardly extending walls 34 are preferably parallel to and laterally spaced from one another, similar to the upwardly extending walls 22.

The upwardly extending walls 22 include first interlocking elements 40 vertically spaced from each other, and the downwardly extending walls 34 include second interlocking elements 50 spaced apart from each other. The elongate drain element 30 is adapted to engage the elongate base element 20 via the first and second interlocking elements 40 and 50, as described in greater detail below. In the embodiment of FIG. 1, the first interlocking elements 40 include first, second, and third longitudinal slots 42,44, and 46 that are vertically spaced from one another. In this embodiment, the second interlocking elements 50 include first and second longitudinal flanges 52 and 54 that are similarly vertically spaced from one another.

The first interlocking elements 40 and the second interlocking elements 50 may be a wide range of physical structures that enable the elongate base element 20 to engage the elongate drain element 30 in two different locations, and the terms first interlocking elements 40 and second interlocking elements 50 are hereby defined to include any structure or structures that perform these functions. The flange and slots may be reversed, for example, or there may be one flange or slot, or any number of flanges or slots. Furthermore, the flanges could be provided by other structures of different shape, and the slots could be various forms of apertures or locking elements. Any alternative structures should be considered within the scope of the present invention.

Both the elongate base element 20 and the elongate drain element 30 are preferably extruded using techniques known in the art. The elongate base element 20 and the elongate drain element 30 are preferably formed of plastic, aluminum, or any other material suitable for the construction of the adjustable drain 10. The materials should be strong enough to not break under ordinary strains, and durable enough to withstand the elements for considerable lengths of time. The elongate drain element 30 in particular should be capable of withstanding considerable exposure to the radiation of the sun.

Figure 2:
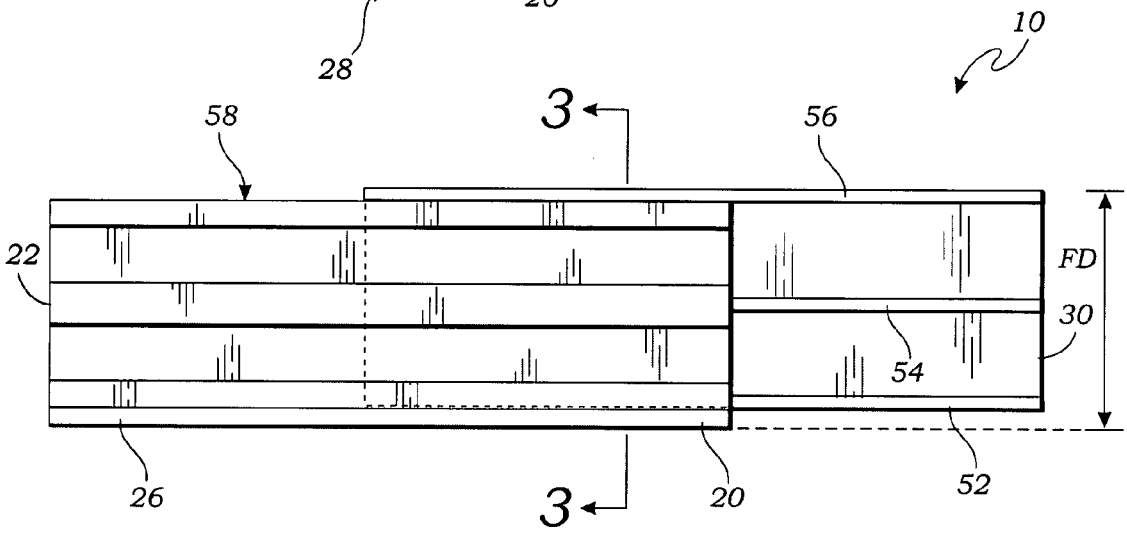
FIG. 2 is a side elevational view of an elongate base element slidably engaging an elongate drain element in a first position.

FIG. 2 is a side elevational view of the elongate base element 20 slidably engaging the elongate drain element 30 in a first position. FIG. 3 is a sectional view thereof taken along line 3-3 in FIG. 2, further illustrating how the outwardly extending base flanges 26 of the elongate base element 20 fit beneath smaller pavers 14 of a stone decking 12.

As illustrated in FIGS. 2 and 3, in the first position the first longitudinal flanges 52 engage the first longitudinal slots 42, and the second longitudinal flanges 54 engage the second longitudinal slots 44. As shown in FIG. 3, in the first position the top surface 32 of the elongate drain element 30 is vertically spaced from the elongate base element 20 by a first distance FD. The first distance FD is approximately equal to or slightly smaller than the smaller thickness ST of the smaller paver 14, such that extended edges 56 of the top surface 32 of the elongate drain element 30 abut top edges 58 of the upwardly extending walls 22, and are adjacent the smaller pavers 14. The extended edges 56 adjacent or, preferably, slightly below a top paver surface 18 of the smaller pavers 14, to facilitate drainage.

Figure 4:
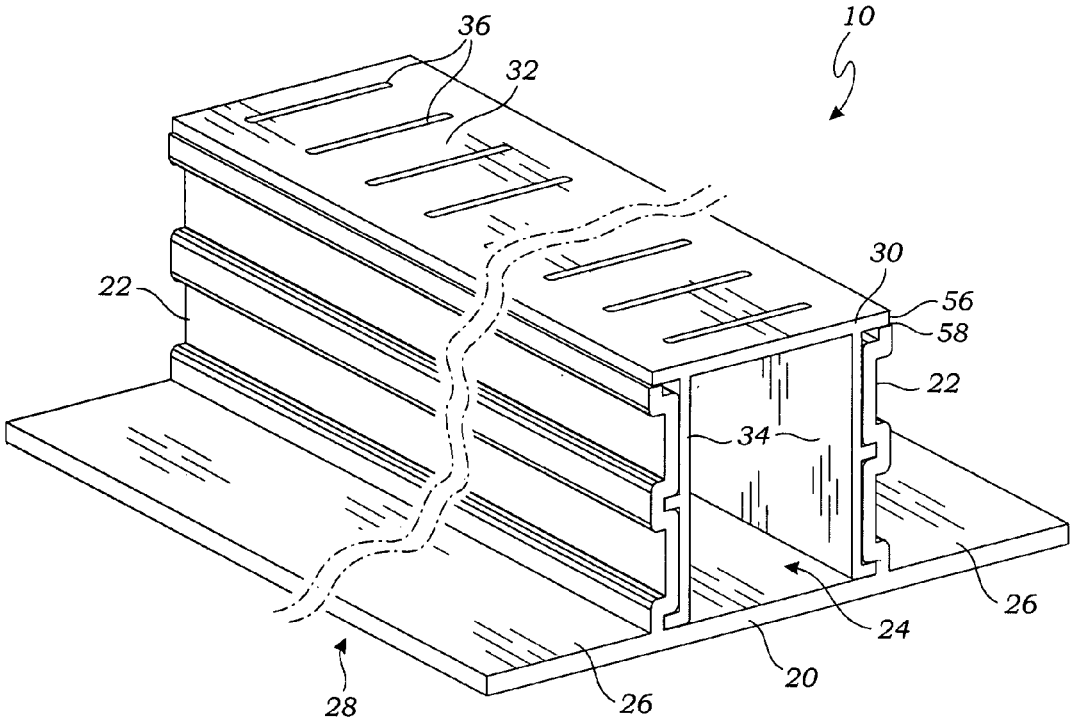
FIG. 4 is a perspective view of the adjustable drain of FIG. 3 without the smaller pavers.

FIG. 4 is a perspective view of the adjustable drain 10 of FIG. 3 without the smaller pavers 14, illustrating how the elongate base element 20 engages the elongate drain element 30 in the first position.

Figure 5:
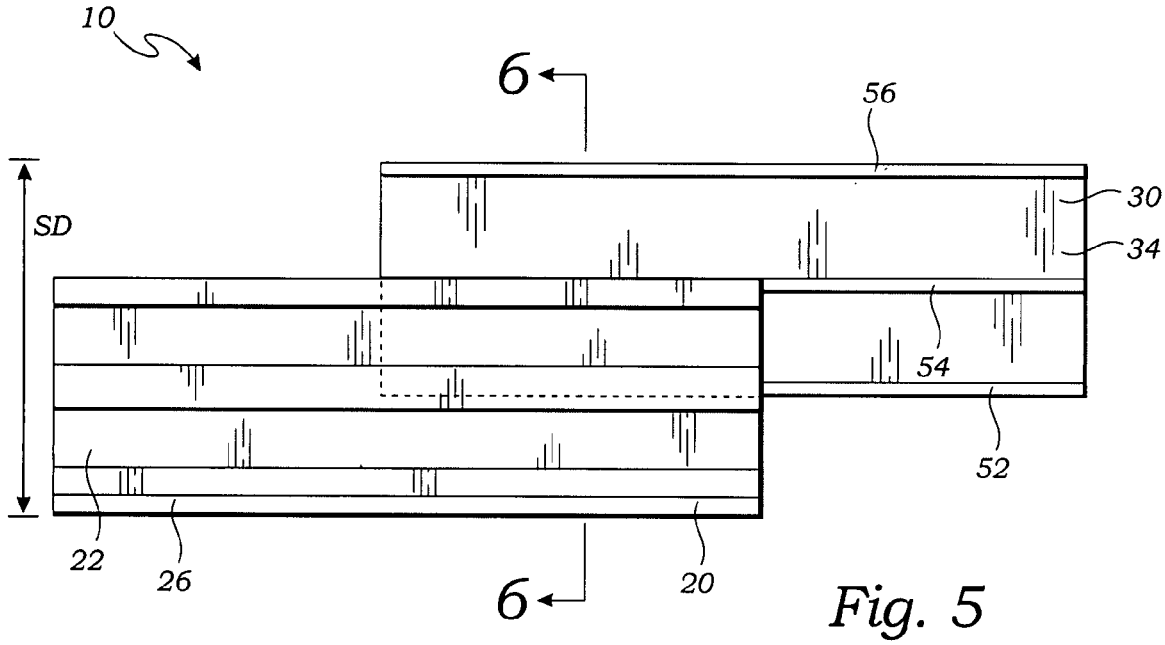
FIG. 5 is a side elevational view of the elongate base element slidably engaging the elongate drain element in a second position.

FIG. 5 is a side elevational view of the elongate base element 20 slidably engaging the elongate drain element 30 in a second position. FIG. 6 is a sectional view thereof taken along line 6-6 in FIG. 5, illustrating how the outwardly extending base flanges 26 of the elongate base element 20 fit beneath larger pavers 16 of a stone decking 12.

As shown in FIGS. 5 and 6, in the second position the first longitudinal flanges 52 engage the second longitudinal slots 44, and the second longitudinal flanges 54 engage the third longitudinal slots 46. As shown in FIG. 6, in the second position the top surface 32 of the elongate drain element 30 is vertically spaced from the elongate base element 20 by a second distance SD. The second distance SD is approximately equal to or slightly less than the larger thickness LT of the larger paver 16, such that extended edges 56 of the top surface 32 of the elongate drain element 30 are raised above the top edges 58 of the upwardly extending walls 22, and are adjacent the larger pavers 16 and slightly below a top paver surface 18 of the larger pavers 16.

While the adjustable drain 10 is illustrated having longitudinal flanges 52 and 54 and longitudinal slots 42, 44, and 46 that enable adjustment to two positions, it should be recognized by those skilled in the art that alternative structures may also be used. Furthermore, the adjustable drain 10 may also be constructed to enable multiple adjustment positions, and the drain is not limited to two adjustment position. Each adjustment position should be adapted to position the top surface 32 of the elongate drain element 30 just below the surface of the stone decking 12, to enable proper drainage from the stone decking 12 into the adjustable drain 10.

While the adjustable drain 10 is preferably used with stone pavers used to construct decking, for purposes of this application, the term "stone decking" is hereby expressly defined to include any form of decking constructed of any materials, including but not limited to stone, concrete, brick, wood, synthetic material, or any other form of material or style of decking that may be suitable for use with the described adjustable drain 10.

While at least one preferred embodiment of the present invention is illustrated above, it should be understood that the presently claimed invention includes alternative embodiments that could be devised by those skilled in the art. The terminology used in the preceding description should be construed to include not only the words used above, but also similar or equivalent words, and alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An adjustable drain comprising:

an elongate base element having upwardly extending walls extending upwardly from the elongate base element;

a first interlocking elements vertically spaced from each other on the upwardly extending walls;

an elongate drain element having a top surface supported by downwardly extending walls, the top surface having a plurality of apertures enabling water to drain through the top surface;

a second interlocking elements spaced apart from each other on the downwardly extending walls, wherein the elongate drain element is adapted to engage the elongate base element via the first and second interlocking elements in either a first position or a second position, wherein the elongate base element and the upwardly extending walls together define a water drainage channel, wherein in the first position the top surface of the elongate drain element is vertically spaced from the elongate base element by a first distance to form a water drainage channel having a first height, and wherein in the second position the top surface of the elongate drain element is vertically spaced from the elongate base element by a second distance to form a water drainage channel having a second height.

2. The adjustable drain of claim 1, further comprising outwardly extending base flanges extending from the elongate base element.

3. The adjustable drain of claim 2, wherein the base flanges form a generally planar anchoring structure adapted to fit under the stone decking adjacent the adjustable drain.

4. The adjustable drain of claim 1, wherein the upwardly extending walls are parallel to and are laterally spaced from one another.

5. The adjustable drain of claim 1, wherein the first interlocking elements are a plurality of longitudinal grooves in the upwardly extending walls that extend the length of the elongate base element, and wherein the second interlocking elements are a plurality of longitudinal flanges extending from the downwardly extending walls, the plurality of longitudinal flanges being adapted to slidably engage selected longitudinal slots.

6. An adjustable drain for stone decking the adjustable drain comprising:

an elongate base element having upwardly extending walls extending upwardly from the elongate base element;

a first interlocking elements vertically spaced from each other on the upwardly extending walls;

an elongate drain element having a top surface supported by downwardly extending walls, the top surface having a plurality of apertures enabling water to drain through the top surface;

a second interlocking elements spaced apart from each other on the downward extending walls, a stone decking surface comprising either small pavers having a smaller thickness or larger pavers having a larger thickness, wherein in the first position the top surface of the elongate drain element is vertically spaced from the elongate base element by a first distance, and wherein in the second position the top surface of the elongate drain element is vertically spaced from the elongate base element by a second distance, wherein the elongate drain element is adapted to engage the elongate base element via the first and second interlocking elements in either a first position corresponding to a smaller thickness of said smaller paver or a second position corresponding to a larger thickness of said larger paver.

7. The adjustable drain of claim 6, further comprising outwardly extending base flanges extending from the elongate base element.

8. The adjustable drain of claim 7, wherein the base flanges form a generally planar anchoring structure adapted to fit under the stone decking adjacent the adjustable drain.

9. The adjustable drain of claim 6, wherein the upwardly extending walls are parallel to and laterally spaced from one another.

10. The adjustable drain of claim 6, wherein the first interlocking elements are a plurality of longitudinal grooves in the upwardly extending walls that extend the length of the elongate base element, and wherein the second interlocking elements are a plurality of longitudinal flanges extending from the downwardly extending walls, the plurality of longitudinal flanges being adapted to slidably engage selected longitudinal slots.

11. The adjustable drain of claim 6, wherein the first distance is less than the smaller thickness of the smaller paver, and wherein the second distance is less than the larger thickness of the larger paver.

* * * * *